US006510954B2

(12) United States Patent
Reddig

(10) Patent No.: US 6,510,954 B2
(45) Date of Patent: Jan. 28, 2003

(54) UPRIGHT FILE STORAGE UNIT

(75) Inventor: Ralph E. Reddig, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/881,192

(22) Filed: Jun. 14, 2001

(65) Prior Publication Data

US 2002/0190019 A1 Dec. 19, 2002

(51) Int. Cl.[7] ..... A47F 5/00
(52) U.S. Cl. ..... 211/162
(58) Field of Search ..... 211/162, 10, 11, 211/46, 94.01, 45, 47

(56) References Cited

U.S. PATENT DOCUMENTS

| | | | | |
|---|---|---|---|---|
| 959,112 A | * | 5/1910 | Cleary | |
| 1,106,344 A | | 8/1914 | De Saussure, Jr. et al. | |
| 2,197,355 A | | 4/1940 | Ulrich | |
| 2,247,593 A | | 7/1941 | Weber | |
| 2,356,473 A | | 8/1944 | Saul, Jr. | |
| 2,579,704 A | | 12/1951 | Saul, Jr. | |
| 2,605,161 A | | 7/1952 | Shampaine | |
| 2,671,566 A | | 3/1954 | Levy, Jr. | |
| 3,472,387 A | | 10/1969 | Olsen | |
| 3,788,718 A | | 1/1974 | Bjorn et al. | |
| 4,077,520 A | | 3/1978 | Stevenson | |
| 5,158,186 A | | 10/1992 | Krut | |
| 5,184,737 A | * | 2/1993 | Hardy | 211/55 |
| 5,779,331 A | | 7/1998 | Fox et al. | |
| 5,950,371 A | | 9/1999 | Rives et al. | |

FOREIGN PATENT DOCUMENTS

| | | |
|---|---|---|
| FR | 942 068 | 1/1949 |
| FR | 2 117 340 | 7/1972 |

* cited by examiner

*Primary Examiner*—Alvin Chin-Shue
*Assistant Examiner*—Sarah Purol
(74) *Attorney, Agent, or Firm*—Flynn, Thiel, Boutell & Tanis, P.C.

(57) ABSTRACT

An upright file storage unit which includes an open-frame defined by a pair of upright and laterally spaced side frame members and upper and lower cross frame members which extend transversely between and interconnect the side frame members. The lower end of the storage unit is supported directly on a floor, and an upper end is supported on a portion of an upright wall member. The side frame members define therein vertically spaced openings such that mounting elements of a hanging-type file folder or other accessories can be engaged, within a pair of laterally adjacent and vertically aligned openings of the respective side frame members. The side frame members are inclined relative to the vertical so that the hanging file folders can be arranged in vertically staggered relationship with one another to provide ready visual access to documents stored therein.

20 Claims, 8 Drawing Sheets

UPRIGHT FILE STORAGE UNIT

FIELD OF THE INVENTION

This invention relates to a file storage unit, particularly for use in an office environment.

BACKGROUND OF THE INVENTION

The modern office has become exceedingly crowded and cluttered due to the increasing amount of equipment utilized by an office worker, such as a computer and the like, and at the same time the need to work on, handle and store large numbers of documents continues to significantly contribute to the overall clutter and crowdedness of the office. Numerous types of tools for organizing information have been developed, including arrangements for storing documents in file folders. Some of these arrangements are of the closed type such as conventional stationary filing cabinets and wheeled pedestal-type file storage units. Other storage arrangements are of the open type such as desk or wall mounted racks. These types of storage arrangements are often bulky, which is a disadvantage with respect to the ever-decreasing amount of available space for offices.

Many of the above-mentioned storage arrangements are adapted for use with hanging file folders, such as those sold under the trademark PENDAFLEX®, due to the benefits associated therewith. For example, U.S. Pat. No. 5,158,186 discloses a hanging file system for use in a confined space such as on the back of a door or in a recessed wall space. The file system is suspended from a vertical surface such as by hooks which engage the upper edge of a door, and parallel and horizontally oriented pairs of support rods are provided on which file folders are suspended. However, this system does not allow ready visual access to the stored files.

The present invention relates to an improved upright file storage unit for the storage of documents therein in a manner which permits easy visual access of documents, while at the same time stores documents in a space-saving manner. More specifically, the file storage unit, in a preferred embodiment, has an open frame structure defined by a pair of upright and laterally spaced side frame members which are joined through upper and lower cross frame members. The side frame members each define therein a plurality of vertically-spaced openings. The openings in the respective side frame members are vertically aligned with one another, such that laterally adjacent pairs of these openings are capable of receiving therein respective hooks associated with conventional hanging file folders. Other accessories are also mountable to the upright side frame members according to the invention, such as a seat assembly and a storage bin.

The file storage unit according to the invention, in one embodiment, has a lower end which is supported on a floor, and the side frame members extend at an angle with respect to the vertical so that files can be positioned in closely adjacent relationship while being suspended one behind the other as the files are positioned upwardly along the storage unit. That is, the files are positionable along the storage unit in a vertically staggered, but horizontally overlapping relationship with one another which provides ready visual access to the stored information, and at the same time provides minimal horizontal protrusion into the work area so as to more efficiently utilize available space therein.

Other objects and purposes of the invention, as well as structural and functional variations thereof, will be apparent to persons familiar with this type of arrangement upon reading the following specification and inspecting the accompanying drawings.

Figure 1:
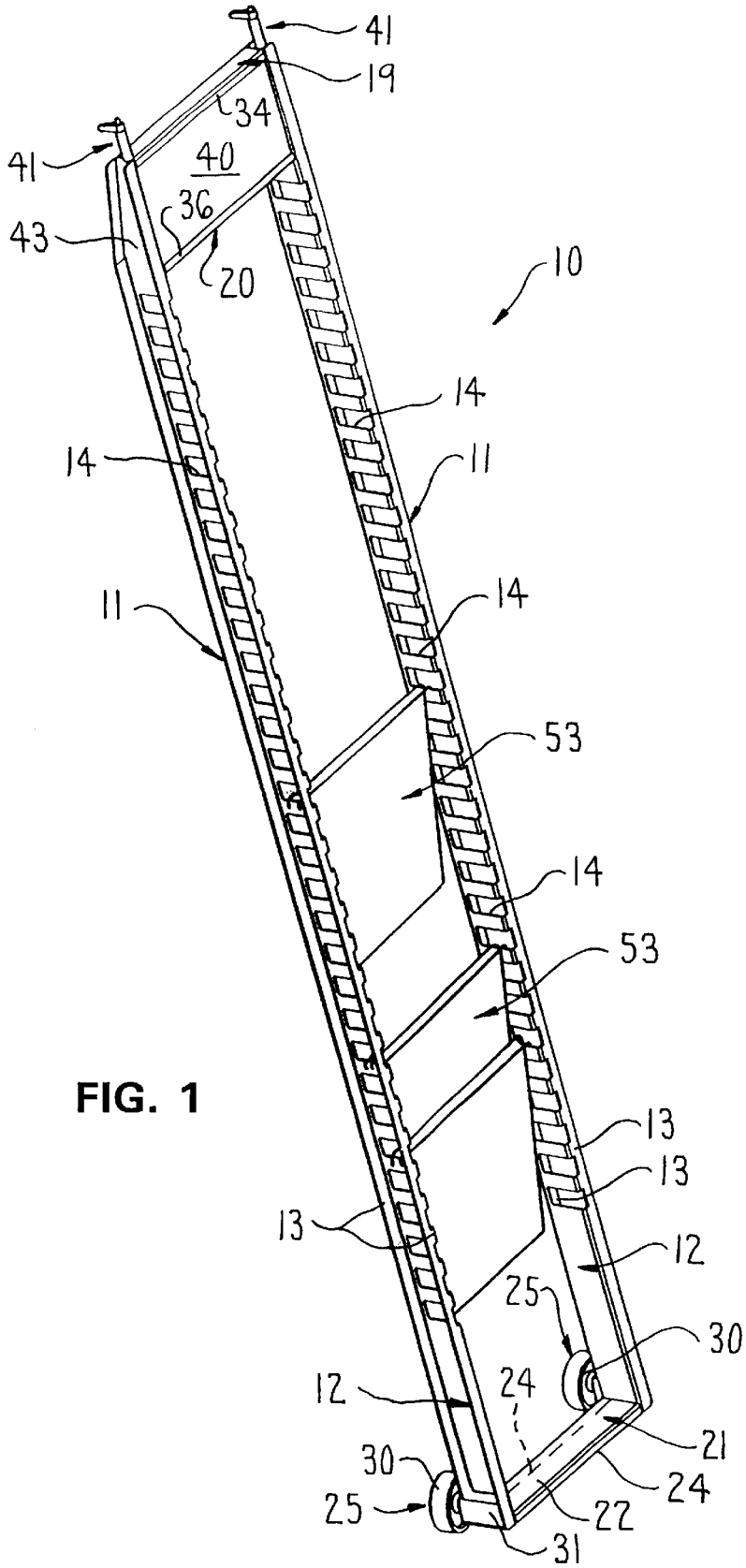
FIG. 1 is a perspective view of the file storage unit according to the invention, on which a plurality of hanging file folders are mounted.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
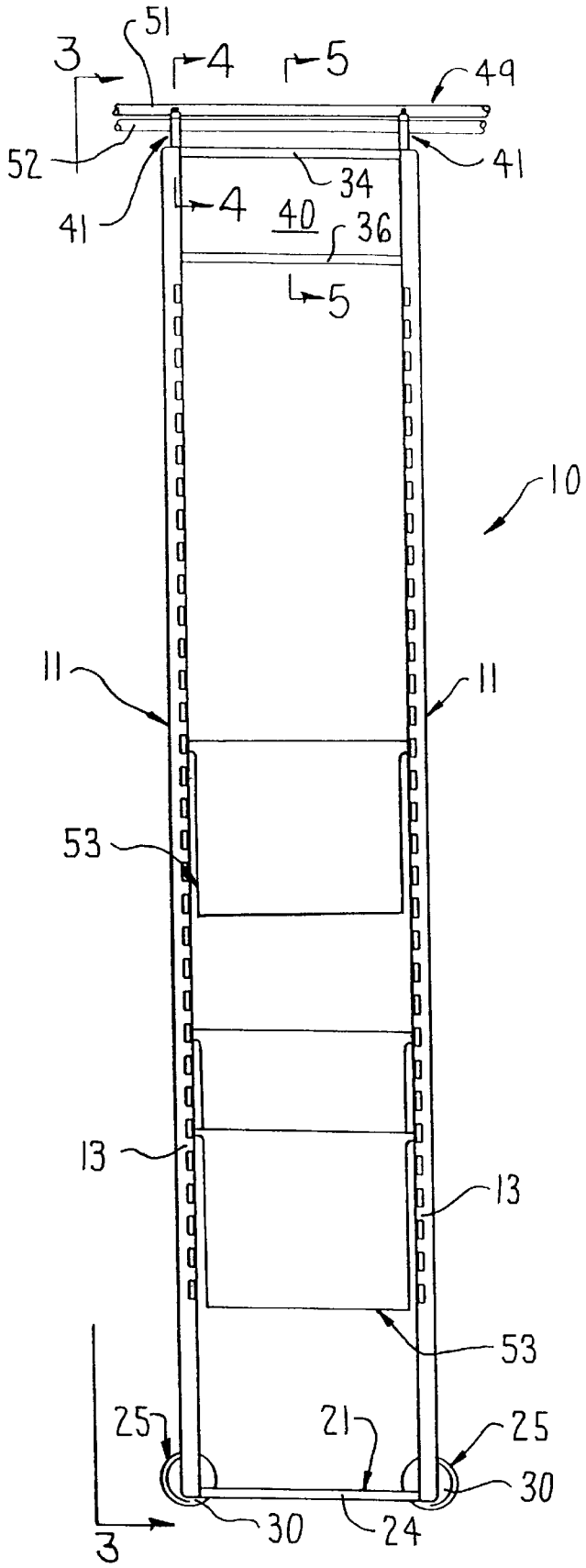
FIG. 2 is a front view of the file storage unit of FIG. 1, which also fragmentarily illustrates a pair of fixed rails on which the upper end of the storage unit is supported.
Figure 3:
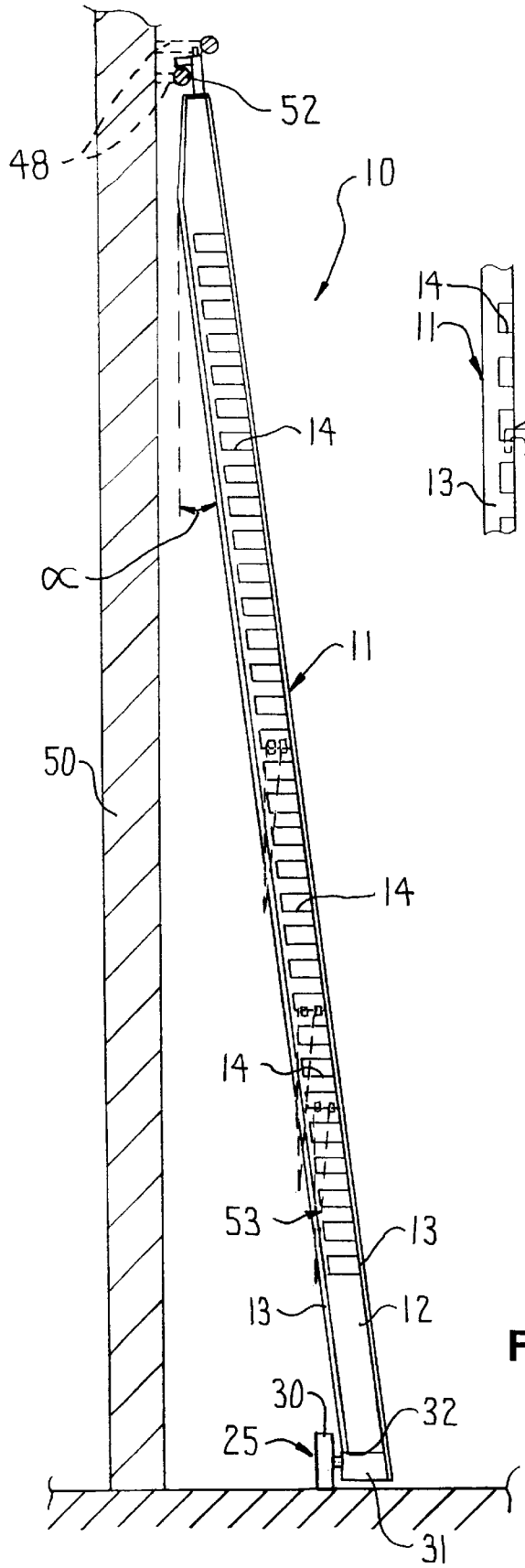
FIG. 3 is a side view of the file storage unit as seen generally along line 3—3 in FIG. 2, which also fragmentarily illustrates an upright wall member and a horizontal support surface.

Referring to FIGS. 1–3, the present invention relates to a file storage unit 10 which is usable in an office-type environment. The storage unit 10 has a rigid open-frame structure defined by a pair of upright and vertically elongate parallel side frame members 11 which are laterally spaced from one another. The upright frame members 11 are mirror images of one another, but are otherwise identical in construction and only one of the frame members 11 will therefore be described in detail herein. The frame member 11 is channel-shaped and includes a flat or planar inner wall 12 and a pair of generally parallel flanges 13 which are cantilevered sidewardly and outwardly from respective upright vertical edges of the inner wall 12. Each side frame member 11 defines therein a plurality of hanger-receiving openings 14 which are vertically spaced from one another at equal distances along substantially the entire vertical extent of frame member 11. Each of the openings 14 is defined both in the inner wall 12 and additionally extends into the front flange 13 of the respective frame member 11, such that each opening 14 opens both sidewardly through inner wall 12 and frontwardly through front flange 13. Further, each opening 14 terminates short of the rear flange 13. In the illustrated embodiment, openings 14 are generally rectangular in shape, and are horizontally elongated.

The upright frame members 11 are joined by a pair of upper transverse channel members 19 and 20 and a lower transverse channel member 21. The lower channel member 21 includes an elongate and generally planar base wall 22 which is oriented generally horizontally and defined by a pair of parallel transverse terminal edges and a pair of parallel longitudinal edges from which a pair of bottom flanges 24 respectively depend downwardly and extend along substantially the entire longitudinal extent thereof. The lower channel member 21 extends between the respective inner faces of frame members 11, and is fixed thereto for example by welding along transverse terminal edges of channel member 21, or alternatively may be fixed to frame members 11 with suitable mounting brackets and fasteners. In the illustrated embodiment, the frame members 11 and channel members 19, 20 and 21 are constructed of a rigid material, such as steel.

A pair of identical roller arrangements 25 are secured to each frame member 11 at lower ends thereof. In the illustrated embodiment, the roller arrangements 25 each include a wheel or roller 30 which is rotatably supported by a mounting block 31. The mounting blocks 31 are secured to the respective frame members 11 adjacent the outer faces of inner walls 12 so as to project in a front-to-back direction of the storage unit 10 and likewise orient the axles of the rollers 30 in a horizontal, front-to-back direction of unit 10. As shown in FIG. 3, the rear flanges 13 of the respective frame members 11 define undercuts 32 so as to terminate short of the base wall 22 to accommodate the respective mounting blocks 31. Mounting blocks 31 may be secured to the respective frame members 11 via welding, brackets or by another suitable method.

Figure 5:
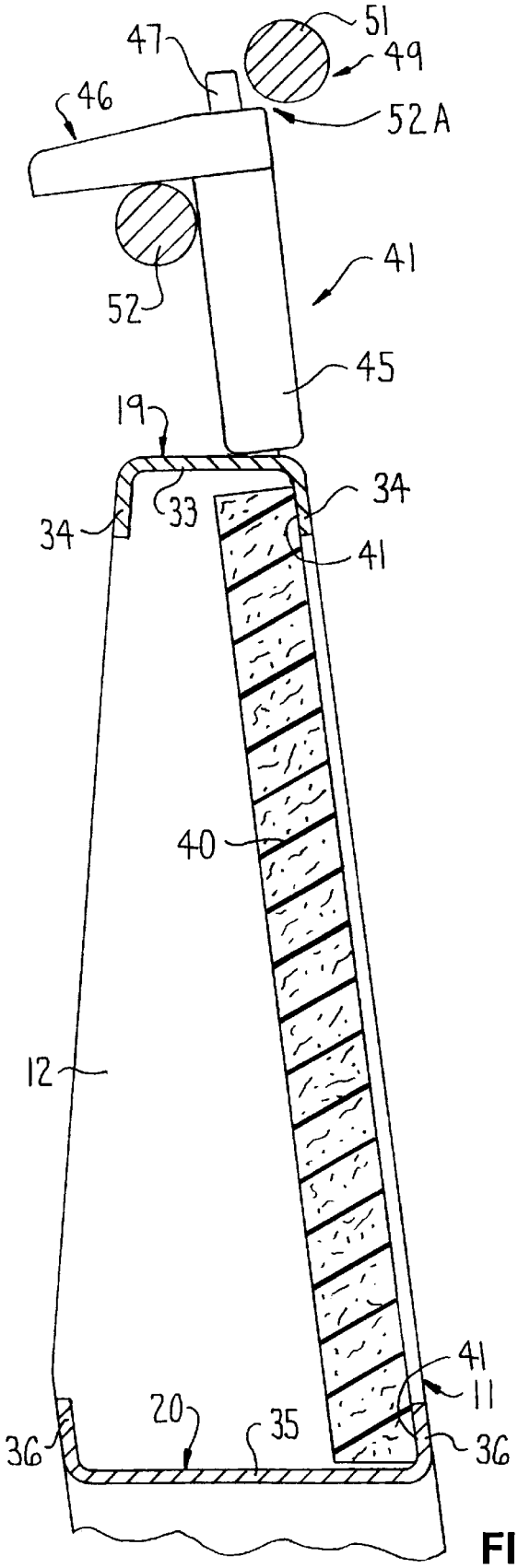
FIG. 5 is an enlarged, fragmentary, cross-sectional view taken generally along line 5—5 in FIG. 2.

Turning now to the upper end of the storage unit 10, and with reference to FIG. 5, the transverse channel member 19 is defined by an elongate planar and generally horizontal wall 33 and a pair of generally parallel front and rear flanges 34 which are respectively cantilevered downwardly from front and rear longitudinal edges of wall 33. The transverse channel member 20 is vertically spaced from channel member 19 a short distance downwardly, and is defined by an elongate planar and generally horizontal wall 35 and a pair of generally parallel front and rear flanges 36 which are respectively cantilevered upwardly from front and rear longitudinal edges of wall 35. The channel members 19 and 20 extend transversely between upper ends of the respective frame members 11 so as to interconnect same and are fixed thereto, for example by welding along the transverse terminal edges of channel members 19 and 20. Alternatively, the channel members 19 and 20 may be secured to the upright frame members 11 through suitable mounting brackets and fasteners.

In the illustrated embodiment, the front flanges 34 and 36 are positioned so as to be generally horizontally flush with the front flanges 13 of frame members 11, and the rear flanges 34 and 36 are horizontally flush with the rear flanges 13. The front flanges 34 and 36 of channel members 19 and 20 are generally coplanar with one another and a sheet 40 of tackable material is fixed to the inner vertical faces 41 of these flanges 34 and 36. Sheet 40 is preferably constructed of a material which is capable of being punctured, such as foam, so as to permit the insertion of push pins and allow the posting of information at the upper end of storage unit 10 at the front side thereof. As shown in FIG. 1, the sheet 40 extends transversely between the respective frame members 11 and extends vertically between the front flanges 34 and 36 so as to close off the upper portion of the open space defined between frame members 11.

Figure 4:
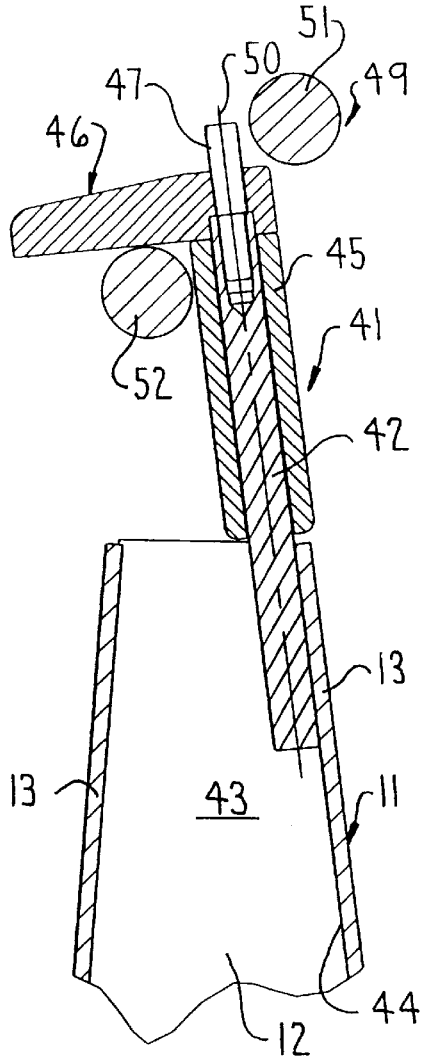
FIG. 4 is an enlarged, fragmentary, cross-sectional view taken generally along line 4—4 in FIG. 2.

With reference to FIGS. 4 and 5, a pair of identical support or locking structures 41 are associated with the upper end of each of the frame members 11. Each support structure 41 includes an upright rod 42, a lower end of which is fixed to the respective frame member 11 in a corner area defined by an outer vertical side surface 43 of the inner wall 12 and a rearwardly facing vertical surface 44 of the respective front flange 13, for example by welding. A spacer sleeve or tube 45 is disposed coaxially about the upper end of the rod 42. A lower end of sleeve 45 is disposed immediately adjacent upper edges of the respective inner wall 12 and front flange 13, and an upper end thereof supports a pivot arm 46 which is rotatably mounted to rod 42 by a pin 47 which projects downwardly into the upper terminal end of rod 42. The arm 46 is thus pivotable relative to the respective frame member 11 about a substantially vertical axis 50 as defined by rod 42. The rod 42, spacer sleeve 45 and arm 46 may be constructed of a rigid material, such as metal, or even a rigid plastic.

As shown in FIGS. 2, 3 and 5, the rollers 30 are positioned in load-bearing relationship with a horizontal support surface such as a floor, and the support structures 41 are supported on a fixed, horizontally extending and rigid rail structure 49. In the illustrated embodiment, the rail structure 49 includes upper and lower elongate and generally parallel rails 51 and 52 which are vertically spaced and horizontally offset from one another. The upper rail 51 is positioned slightly forwardly with respect to the lower rail 52. The rail structure 49 may be mounted to a fixed wall defining part of a work space, or may be mounted to the upper region of a space-dividing upright panel assembly commonly used to subdivide an office area into one or more separate work areas as represented by reference number 50 in FIG. 3, for example by supports 48 which extend outwardly from the wall member 50 as shown in broken lines. The rail structure 49 may extend horizontally along the entire longitudinal extent of the wall or panel, or along only a portion thereof.

The storage unit 10 is mounted to the rail structure 49 as follows. The arms 46 of the respective support structures. 41 are each pivoted from the position shown in FIGS. 4 and 5 into a sidewardly-oriented position so that same are generally parallel with respect to the elongated direction of the upper and lower rails 51 and 52. The storage unit 10 is then tilted at an angle relative to the vertical (i.e. by pivoting the lower end upwardly) and lifted upwardly so as to insert the pivot arms 46 and the respective upper ends of spacer sleeves 45 into the channel 52A defined between the respective rails 51 and 52. The lower end of the storage unit 10 is then pivoted back downwardly so as to bring the rollers 30 into engagement with the floor, and the upper ends of the respective spacer sleeves 45 engage and rest upon the front surface of the lower rail 52. The pivot arms 46 are then rotated back into the position shown in FIGS. 4 and 5 so as to engage the upper surface of the lower rail 52.

The frame members 11 of the storage unit 10 extend upwardly at a slight angle relative to the vertical and define an angle of slightly less than 90° with the rotational axes of the respective rollers 30, such that when the storage unit 10 is positioned adjacent a vertical surface such as the wall member 50, hanging file folders 53 can be positioned in closely adjacent and horizontally overlapping relationship while being vertically staggered with respect to one another along the upward extension of the storage unit 10. In the illustrated embodiment, angle $\alpha$ is less than about 20°, and may be about 6½°. The storage unit 10 according to the invention thus has a minimal horizontal projection, and the inclined structure thereof enables compact storage of many file folders 53 while providing visual access thereto due to the vertically staggered arrangement of the files 53.

Figure 6:
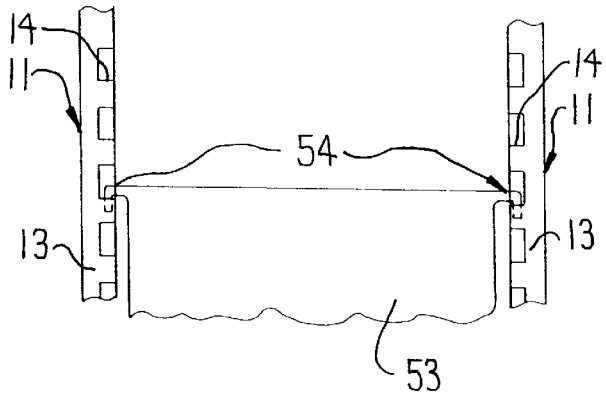
FIG. 6 is an enlarged, fragmentary front view of the file storage unit illustrating the mounting of a hanging file folder thereon.

As shown in FIG. 6, a hanging file folder 53 is mounted on the storage unit 10 by positioning same generally between the respective frame members 11, and inserting respective laterally-spaced hooks 54 thereof into a pair of laterally adjacent and vertically aligned openings 14 of the respective frame members 11. In this regard, the frontwardly opening portions of the respective openings 14 facilitate insertion of the hooks 54 thereinto. The horizontally elongated shape of the openings 14 also allows a plurality of folders 53 to be suspended from a single pair of laterally adjacent openings 14 of frame members 11, and also accommodates bulky folders 53.

The support structures 41 and cooperating rail structure 49 together prevent toppling of the storage unit 10, for example due to a person or object bumping into the unit 10. More specifically, a force applied to the lower rear side of the unit 10 will pivot the lower end thereof upwardly, causing the arms 46 and spacer sleeves 45 to pivot or rotate in a counterclockwise direction about lower rail 52 (with respect to FIGS. 3 and 5) so that the arms 46 maintain their engagement with the lower rail 52. Further, a force applied to the lower front side of the unit 10 will cause the arms 46 and spacer sleeves 45 to pivot or rotate about lower rail 52 in a clockwise direction, and cause the upper free ends of the pins 47 to engage the rear surface of the upper rail 51 and prevent disengagement of the support structures 41 from the lower rail 52.

It will be appreciated that the arms 46 need not necessarily contact the upper surface of lower rail 52, and may instead be spaced slightly upwardly from rail 52 while still preventing toppling of the storage unit 10 as discussed above.

It will also be appreciated that the above rail and support structures 49 and 41 are presented only as an example of one type of upper support arrangement which may be used in conjunction with the present invention. For example, a sidewardly-opening C-shaped channel member may be fixed to the upright wall or panel member 50 and a hook structure may be provided at the upper end of the storage unit 10 which engages within the bottom of the C-shaped channel member so as to positively interlock the hook structure within the channel member. Alternatively, a single rail may be provided and a hook structure may be provided at the upper end of storage unit 10 which has a downwardly depending arm which engages over the rail.

The above arrangement including the rollers 30 and the support structures 41 which engage the lower rail 52 allow the storage unit 10 to be manually moved laterally within the work area. That is, with the lower end of the storage unit 10 supported on the floor via rollers 30 and the upper end supported on the rail structure 49, a manual force can be applied to one of the side frame members 11 which causes rotation of the rollers 30 and sliding of the sleeve members 45 and arms 46 along the lower rail 52 so that the unit 10 can be moved laterally along the rail 52 to a desired location within a work area.

Figure 7:
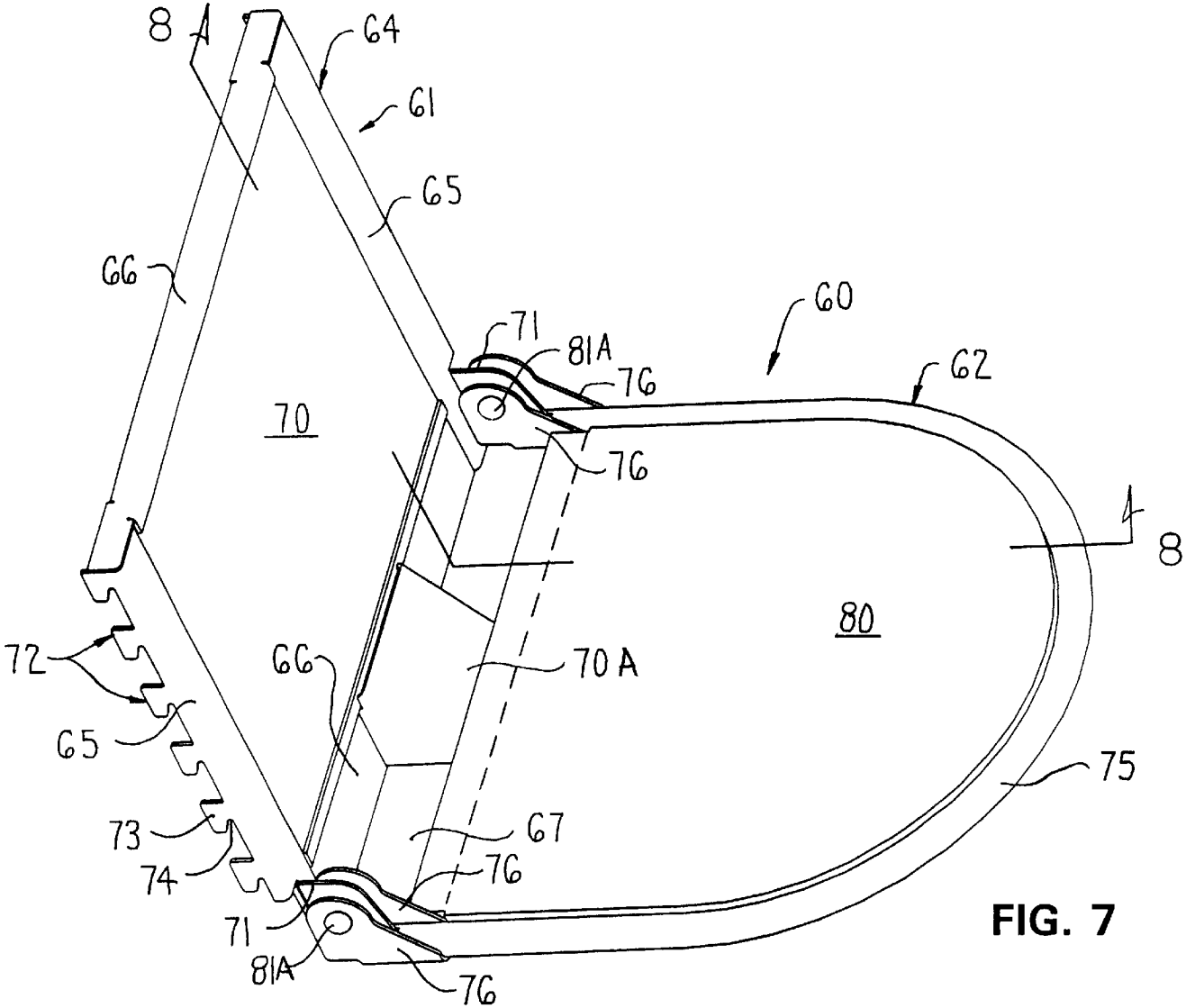
FIG. 7 is an enlarged perspective view of a seat assembly which is mountable on the file storage unit.
Figure 8:
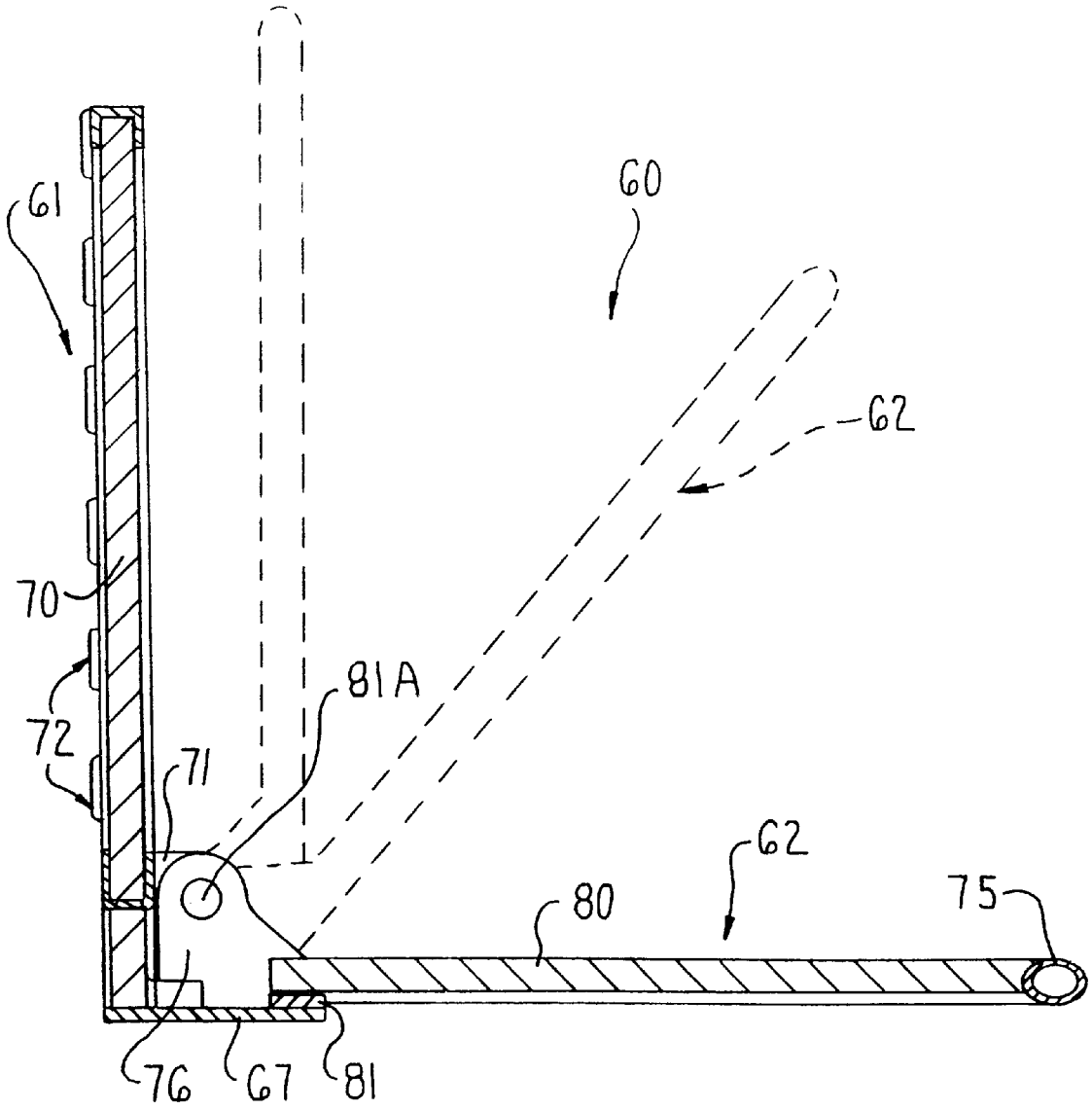
FIG. 8 is a cross-sectional view of the seat assembly taken generally along line 8—8 in FIG. 7, wherein closed and intermediate positions of the seat platform are illustrated in broken lines.

FIGS. 7–12 illustrate various accessories which may be utilized with the storage unit 10 according to the invention. FIGS. 7 and 8 show a seat assembly 60 which is mountable on the storage unit 10. Seat assembly 60 includes a back rest 61 and a seat platform 62 which are interconnected to one another through a hinge arrangement.

The back rest 61 has a generally rectangular and rigid frame 64 defined by a pair of upright and generally parallel side frames 65 and upper and lower generally parallel frames 66 which extend transversely between the respective side frames 65. A rigid and planar upright panel member 70 is fixed to the frame 64. In the illustrated embodiment, the panel member 70 is constructed of honeycomb which is impregnated with resin to provide rigidity. If desired, the panel member 70 may be covered with a cushion (not shown) on the side thereof facing seat platform 62. The lower frame 66 mounts thereon a frontwardly projecting stop plate 67 which is generally horizontally oriented when the seat assembly 60 is mounted on the storage unit 10, and a reinforcing gusset 70A is provided in the corner defined between the front face of lower frame 66 and the upper surface of stop plate 67. Further, a pair of generally parallel and upright hinge plates 71 are fixed to a lower end of frame 64 and are horizontally spaced from one another on opposite sides of gusset 70A. In the illustrated embodiment, stop plate 67 extends across the entire width of the seat assembly 60.

Upright side frames 65 each include a plurality of rigid mounting hooks 72 which are vertically spaced from one another at equal distances and in rows along substantially the entire vertical extent of the respective frames 65. Each mounting hook 72 includes a downwardly projecting leg 73 which defines a downwardly opening slot 74. The mounting hooks 72 along the rear side of back rest 61 are spaced from one another by a vertical distance which corresponds to the vertical distance defined between each vertically adjacent pair of openings 14 of storage unit 10 to allow mounting of the seat assembly 60 thereon as discussed further below.

The seat platform 62 of seat assembly 60 in the illustrated embodiment includes a rigid arcuate frame member 75 having a pair of upright and parallel hinge plates 76 mounted on opposite terminal and laterally-spaced ends thereof. In the illustrated embodiment, frame member 75 has a tubular configuration. A generally planar and rigid panel member 80 is supported on and fixed to the frame member 75 and may include a cushion (not shown) on the upper surface thereof. Panel member 80, like panel member 70, in the illustrated embodiment is constructed of honeycomb impregnated with resin. It will be appreciated that other materials may be utilized in constructing panel members 70 and 80, provided that same are sufficiently rigid.

As shown in FIG. 8, a plate-like stop member 81 is fixed to the bottom of the frame member 75 and extends between the opposite laterally-spaced terminal ends thereof slightly forwardly from the hinge plates 76. The back rest 61 and seat platform 62 (except for panel members 70 and 80) are constructed of a rigid material, such as metal.

Each pair of hinge plates 76 of seat platform 62 are disposed on opposite sides of a respective hinge plate 71 of back rest 61, and a hinge pin 81A extends through the respective hinge arrangements to pivotably interconnect the back rest 61 to the seat platform 62. The seat platform 62 is thus pivotable relative to back rest 61 about the axis defined by the respective aligned hinge pins 81A, as illustrated in broken lines in FIG. 8. In this regard, the seat assembly 60 can be folded into a closed configuration wherein the two opposed halves thereof are disposed in juxtaposed, face-to-face relation with one another for storage or transport (shown in broken lines). If desirable or necessary, a locking device (not shown) can be provided to retain the seat assembly 60 in the folded configuration when not in use.

When use of the seat assembly 60 is desired, the seat platform 62 is pivoted downwardly and away from the back rest 61, until the stop member 81 of the seat platform 62 abuts the stop plate 67 of back rest 61. The stop plate 67 of back rest 61 thus prevents further downward movement of the seat platform 62, and the back rest 61 and seat platform 62 are disposed at an approximate right angle relative to one another when in the open configuration. The rows of mounting hooks 72 of the back rest 61 are then respectively inserted into corresponding pairs of laterally spaced and vertically aligned openings 14 of storage unit 10 at the desired height by inserting the downwardly projecting legs 73 thereof into the frontwardly opening portions of openings 14, so that the upper edges of the frame members 11 which define the lower edges of the respective openings 14 engage within the downwardly opening slots 74. Alternatively, the seat assembly 60 may first be mounted on the storage unit 10 in the folded configuration, and the seat platform 62 pivoted downwardly thereafter.

When the seat assembly 60 is mounted on the storage unit 10, the back rest 61 is tilted slightly rearwardly relative to the vertical, and the front edge of the seat platform 62 is tilted slightly upwardly relative to the horizontal. The storage unit 10 can thus be utilized in conjunction with the seat assembly 60 to create an additional seating area within a work space, without the need for utilizing conventional seating components such as office chairs which are often bulky and as a result consume a large amount of available work space.

FIGS. 9–12 illustrate an additional accessory which may be utilized with the storage unit 10 according to the invention. More specifically, one or more storage bins 84 may be mounted on the unit 10 so as to create additional storage areas for documents or other work-related accessories. The storage bin 84 is of a box-like construction defined by a pair of upright and generally vertical and planar side walls 85 which are parallel to one another, generally planar and horizontally oriented top and bottom walls 86 which extend transversely between and interconnect the respective side walls 85, and a generally vertical and planar rear wall 87 which extends transversely between the rear vertical edges of the side, top and bottom walls so as to close off the rear of the storage bin 84. The storage bin 84 in the illustrated embodiment thus defines a hollow interior 89 which opens forwardly through an open front end 90, which is defined by a front flange 91 which extends peripherally along the front edges of the top, bottom and side walls.

Figure 10:
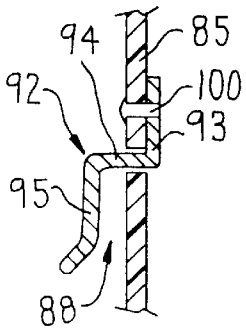
FIG. 10 is an enlarged, fragmentary cross-sectional view taken generally along line 10—10 in FIG. 9.
Figure 11:
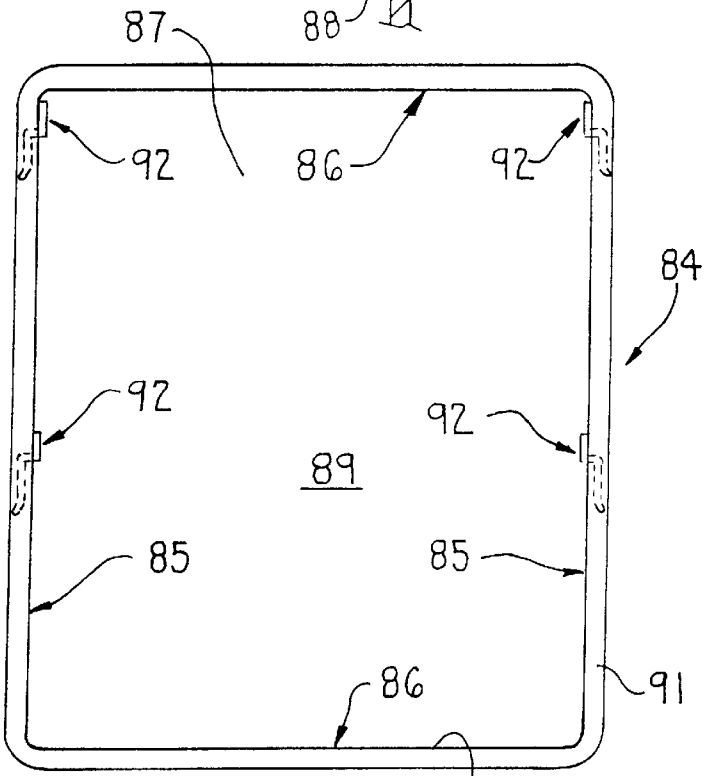
FIG. 11 is a front view of the storage bin as seen generally along line 11—11 in FIG. 9.
Figure 9:
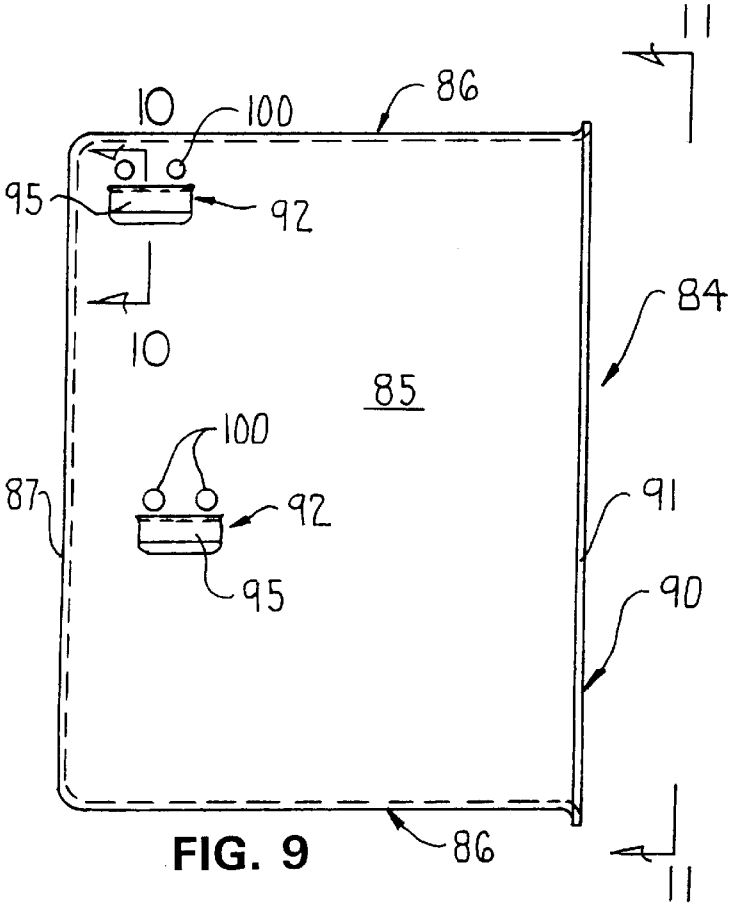
FIG. 9 is an enlarged side view of a storage bin which is mountable on the file storage unit.

As shown in FIGS. 9 and 10, a pair of mounting brackets 92 are fixed to each of the side walls 85 for securing the storage bin 84 to the respective upright frame members 11. The mounting brackets 92 each include an upright top leg 93 which is superimposed on an inwardly facing side surface of the respective side wall 85, an intermediate leg 94 which is generally perpendicular to the top leg 93 and projects sidewardly and outwardly from a lower edge thereof through an opening formed in the side wall 85, and a lower leg 95 which projects downwardly from an outer terminal edge of intermediate leg 94 in generally parallel relation with top leg 93. The lower leg 95 is generally parallel with the respective side wall 85 and is horizontally spaced from an outer side surface thereof so as to define a downwardly opening slot 88 therewith.

As shown in FIG. 9, the respective pairs of mounting brackets 92 are vertically spaced from one another, and are positionally offset from one another. That is, the upper bracket 92 is spaced closer to the rear wall 87 than the lower bracket 92 so as to accommodate the inclination of the storage unit 10 and be mountable within the openings 14. The brackets 92 are mounted with fasteners 100 to the respective side walls 85 near the rear wall 87 so that the storage bin 84 projects a substantial distance forwardly from the respective frame members 11 when mounted thereon as discussed below. In the illustrated embodiment, the storage bin 84 is constructed of rigid plastic such as by molding, and the mounting brackets 92 may be constructed of metal.

Figure 12:
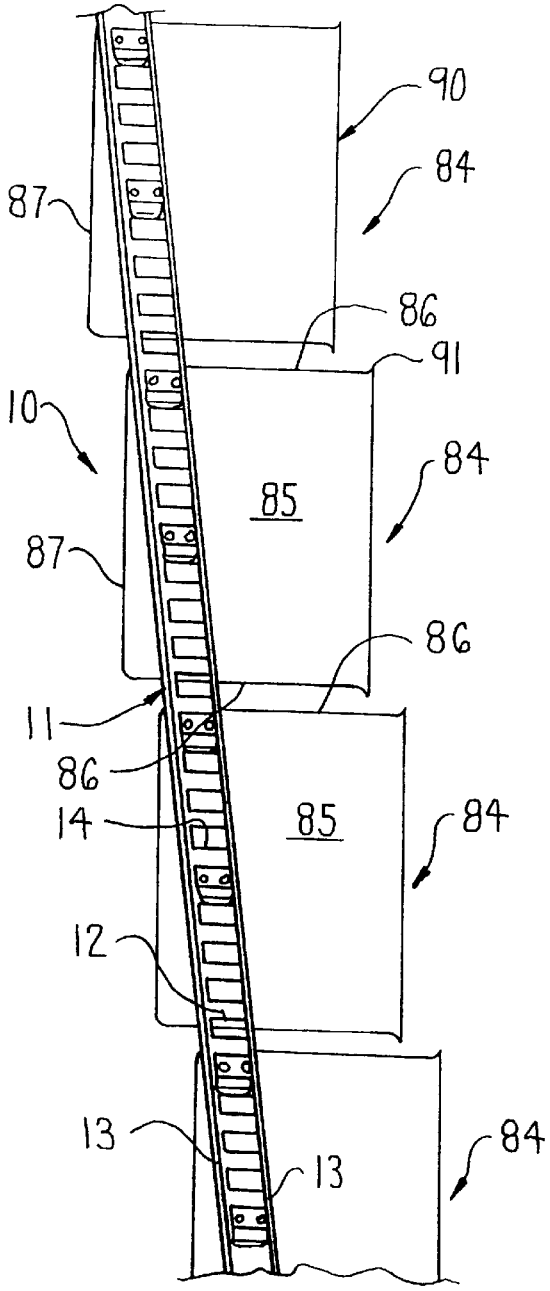
FIG. 12 is a fragmentary side view of the file storage unit on which a plurality of storage bins are mounted one above the other.

The storage bin 84 is mounted on the storage unit 10 by positioning the bin 84 generally between the respective frame members 11, and inserting the lower legs 95 of the brackets 92 on the respective side walls 85 into correspondingly located openings 14 of the respective frame members 11, and sliding the bin 84 downwardly so that the inner walls 12 which define the lower edges of the respective openings 14 engage within the respective downwardly opening slots 88 of brackets 92. A storage bin 84 may be mounted on storage unit 10 alone, or along with hanging file folders 50 or seat assembly 60, or a plurality of storage bins 84 may be mounted vertically one above the other along storage unit 10 as shown in FIG. 12.

The storage bin 84 may be utilized to store papers or documents therein by stacking same on the bottom wall 86, or other work related objects may be supported on bottom wall 86. Further, it may be desirable to store documents in a vertically upright manner within the hollow interior 89 of bin 84, and a plurality of upright divider walls (not shown) could be provided within interior 89 so as to support the documents in an upright fashion. Alternatively, the divider walls could be provided within interior 89 in a horizontal manner, for example, through mounting flanges or other supports located along the interior surfaces of the respective side walls 85 so as to provide a shelf-like arrangement within the storage bin 84.

Figure 13:
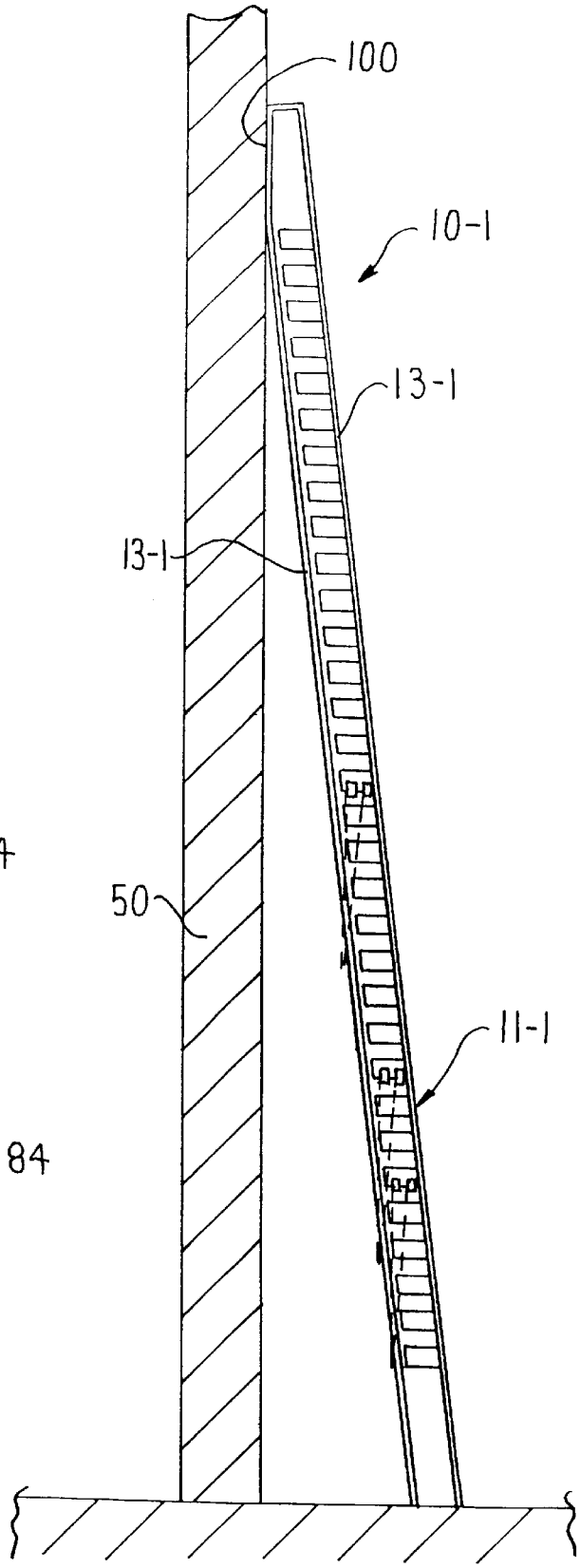
FIG. 13 is a modification of the file storage unit which is supportable directly on a vertical surface, such as an upright wall or panel.

FIG. 13 illustrates an alternative embodiment of a storage unit which is similar to the storage unit 10, but differs from same in the construction of the upper and lower ends. Parts which are similar or identical to parts of storage unit 10 are identified with the same reference numbers plus a "–1". The lower end of the storage unit 10-1 shown in FIG. 13 is not provided with rollers 30 as in the previous embodiment, and instead is supported directly on a horizontal support surface or floor. The lower end may be fixed to the support surface, for example through suitable mounting plates and fasteners (not shown), or alternatively may be provided with a non-skid material on the lower edges of frame members 11-1 to prevent slippage. The upper end of the storage unit 10-1 includes a generally vertical rear surface 100 which is superimposed on a fixed wall or wall panel member 50. Similar to the lower end, the upper end may also be secured to the wall through mounting plates and fasteners, or the vertical surface 100 may be provided with a non-skid material.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A file storage assembly comprising:

an open frame defined by a pair of upright side frame members which are laterally spaced from and generally parallel to one another, and a pair of cross frame members which extend transversely between said side frame members to interconnect same adjacent respective upper and lower portions thereof; and a lower end disposed in supportive engagement with a floor and an upper end disposed in supportive engagement with a portion of an upright wall member;

said side frame members each defining therein a plurality of openings which are vertically spaced from one another along the vertical extensions of said side frame members such that vertically aligned pairs of said openings are capable of receiving therein mounting elements of a hanging-type file folder, said side frame members being disposed at an angle relative to the vertical to permit a plurality of hanging-type file folders to be positioned in vertically staggered and horizontally overlapping relationship along said side frame members.

2. The storage assembly of claim 1 wherein a pair of rollers are mounted on said lower end and disposed in load-bearing relation with a floor, and said upper end is slidably engaged with said portion of the wall member such that said storage assembly is manually movable laterally along the wall member.

3. The storage assembly of claim 1 wherein said side frame members each include an elongate inner wall and a front flange which is cantilevered sidewardly from a frontwardly oriented vertical side edge of said inner wall, each of said openings opening both sidewardly through said inner wall and frontwardly through the respective front flange such that said openings are accessible from a front side of said storage assembly.

4. The storage assembly of claim 1 including a tackable surface disposed adjacent said upper end thereof for posting information thereon.

5. The storage assembly of claim 4 wherein a sheet of foam material defining said tackable surface thereon is secured to an upper one of said cross frame members.

6. The storage assembly of claim 1 wherein one of said cross frame members is a first upper cross frame member and the other of said cross frame members is a lower cross frame member, and said assembly further includes a second upper cross frame member spaced downwardly from said first upper cross frame member and extending transversely between said side frame members, said first and second upper cross frame members respectively defining downwardly and upwardly projecting frontwardly oriented flanges which are cantilevered from respective base walls thereof, and a sheet of tackable material is secured to said flanges and defines a frontwardly facing tackable surface adjacent said upper end of said storage assembly for posting information thereon.

7. The storage assembly of claim 1 wherein said side frame members have a channel-like construction defined by an upright and generally planar inner wall and front and rear flanges which are cantilevered outwardly from opposite vertical side edges of the respective inner wall, said openings being defined in said inner wall and additionally extending sidewardly into the respective front flange such that said openings are accessible from a front side of said storage assembly.

8. The storage assembly of claim 1 further including a box-like storage bin including a mounting structure which cooperates with said openings of said side frame members to mount said storage bin on said storage assembly.

9. The storage assembly of claim 8 wherein said storage bin includes a pair of upright, spaced-apart and generally parallel side walls and top and bottom walls which extend transversely between and interconnect said side walls, a mounting bracket fixed to each said side wall and engaging within one of said openings of a respective side frame member, and a rear wall which extends between said side, top and bottom walls such that said storage bin opens forwardly.

10. The storage assembly of claim 1 further including a seat assembly including an upright back rest having a lower edge portion connected to a generally horizontally oriented seat platform, said back rest including a hook arrangement mounted adjacent a rear side thereof which is engaged with a pair of vertically aligned and laterally adjacent openings of the respective said side frame members.

11. The storage assembly of claim 10 wherein said back rest includes a pair of vertical upright side edges and said hook arrangement includes a plurality of rearwardly projecting hooks disposed along each of said upright side edges, said hooks being vertically spaced from one another by a distance which corresponds to a vertical distance defined between each vertically adjacent pair of said openings in each said side frame member such that said seat assembly is mountable at a selected height along said side frame members.

12. A work station including:

an upright wall member mounting thereon a rail structure defining a channel therein and extending generally horizontally along said wall member;

a vertically elongate file storage unit having a pair of interconnected elongate and upright support elements each defining therein a plurality of openings which are vertically spaced from one another along the respective upright elements, laterally spaced pairs of said openings of the respective support elements being vertically aligned with one another for respectively receiving mounting elements of a hanging-type file folder therein;

a lower end mounting thereon a roller arrangement disposed in supportive engagement with a generally horizontally oriented support surface; and an upper end mounting thereon a locking member which engages within said channel to permit rolling lateral movement of said storage unit along said rail structure and relative to said wall member.

13. The work station of claim 12 wherein said locking member lockingly engages within said channel to prevent toppling of said file storage unit.

14. The work station of claim 12 wherein said rail structure includes upper and lower elongate rails which are vertically spaced from one another to define said channel therebetween, said channel opening generally sidewardly and said locking member projecting into said channel and having a portion which slidably engages a lower one of said rails.

15. The work station of claim 12 wherein a pair of said locking members are respectively fixed to upper ends of said support elements and project generally upwardly therefrom, and said rail structure includes upper and lower elongate rails which are vertically spaced from one another to define said channel therebetween and are horizontally offset with respect to one another such that an upper one of said rails is disposed forwardly from a lower one of said rails, said locking members each including an arm which projects rearwardly into said channel and engages an upper surface of said lower rail, said arm being pivotable about a generally vertical axis to permit insertion of said locking members into said channel.

16. The work station of claim 12 wherein said storage unit includes upper and lower cross members which interconnect said support elements adjacent upper and lower portions thereof to provide said storage unit with an open configuration such that a hanging-type file folder is suspendable from said support elements so as to extend downwardly therebetween.

17. The work station of claim 12 wherein said support elements are inclined relative to the vertical and project rearwardly towards said wall member as same project upwardly from said lower end of said storage unit.

18. An upright file storage unit comprising:

a pair of vertically elongate, channel-shaped and parallel side frame members which are laterally spaced from one another by upper and lower frame members which extend transversely between said side frame members at respective upper and lower ends thereof, said side, upper and lower frame members together defining a generally rectangular open frame;

each said side frame member defining therein a plurality of hanger-receiving openings therein which are vertically spaced apart from one another by equal distances along the respective side frame member, laterally adjacent pairs of said openings of said side frame members being vertically aligned with one another to permit the mounting of a hanging-file folder thereon with mounting elements thereof engaging within the respective laterally adjacent openings and the folder projecting downwardly between said side frame members, said side frame members being inclined relative to the vertical such that a plurality of hanging-file folders are positionable along said storage unit in vertically staggered relationship with one another;

a pair of rollers disposed at opposite lower corners of said frame which supportingly engage a floor surface; and a pair of locking members disposed at opposite upper corners of said frame which cooperate with a fixed rail structure associated with an upright wall member disposed in generally perpendicuiar relation with the floor surface.

19. The storage unit of claim 18 wherein said openings are horizontally elongated so as to permit either a plurality of hanging-file folders to be mounted therein in horizontally overlapping relationship with one another or to permit a large amount of documents to be stored within a single hanging-file folder.

20. The storage unit of claim 18 wherein a tackable surface is defined on a front side of said unit adjacent said upper end thereof for posting information thereon.

* * * * *